US007283642B2

(12) United States Patent
Milot et al.

(10) Patent No.: US 7,283,642 B2
(45) Date of Patent: Oct. 16, 2007

(54) MOVING-COIL ELECTRODYNAMIC MOTOR FOR A LOUDSPEAKER, LOUDSPEAKER AND POLE PIECE

(75) Inventors: Gilles Milot, Paris (FR); Francois Malbos, Leveque (FR)

(73) Assignee: Harman International Industries, Incorporated, Northbridge, CA (US)

( * ) Notice: Subject to any disclaimer, the term of this patent is extended or adjusted under 35 U.S.C. 154(b) by 0 days.

(21) Appl. No.: 10/504,811

(22) PCT Filed: Feb. 13, 2003

(86) PCT No.: PCT/FR03/00470

§ 371 (c)(1),
(2), (4) Date: Apr. 5, 2005

(87) PCT Pub. No.: WO03/069953

PCT Pub. Date: Aug. 21, 2003

(65) Prior Publication Data

US 2005/0226457 A1 Oct. 13, 2005

(30) Foreign Application Priority Data

Feb. 13, 2002 (FR) ..... 02 01782

(51) Int. Cl.
*H04R 25/00* (2006.01)

(52) U.S. Cl. ..... 381/400; 381/412; 381/420

(58) Field of Classification Search ..... 381/396, 381/412, 414, 419, 420, 421, 422, 400, 401
See application file for complete search history.

(56) References Cited

U.S. PATENT DOCUMENTS 3,867,587 A * 2/1975 Yamamuro ..... 381/414
3,922,501 A 11/1975 Yamamuro
5,357,587 A 10/1994 Grodinsky et al.
6,829,366 B2 * 12/2004 Tanabe ..... 381/412
2003/0133587 A1 * 7/2003 Hyre et al. ..... 381/412

FOREIGN PATENT DOCUMENTS

| | | |
|---|---|---|
| JP | 56120109 A | 9/1981 |
| JP | 57028563 A | 2/1982 |
| JP | 61137496 A | 6/1986 |
| WO | WO01/06523 | 1/2001 |

OTHER PUBLICATIONS

International Search Report for Application No. PCT/FR03/00470 (filed Feb. 13, 2003), mailed Jul. 16, 2003 (4 pages).

Preliminary Search Report for French Application No. FR 02/01782 (filed Feb. 13, 2002), dated Dec. 24, 2002 (4 pages).

* cited by examiner

*Primary Examiner*—Huyen Le
(74) *Attorney, Agent, or Firm*—Brinks Hofer Gilson, & Lione

(57) ABSTRACT

The invention relates to a moving-coil electrodynamic motor and a loudspeaker. A moving-coil includes a winding with a given number of turns. A motor comprises a magnet arranged between a front pole piece and a rear pole piece. The front pole piece and the rear pole piece enclose a magnetic field in a gap and the moving coil is arranged in the gap. The gap may include a groove arranged essentially parallel to the turns. The coil has a height less than or equal to the height of the gap and the groove forms a recessed zone with an internal ring made from electrically conducting material.

24 Claims, 6 Drawing Sheets

MOVING-COIL ELECTRODYNAMIC MOTOR FOR A LOUDSPEAKER, LOUDSPEAKER AND POLE PIECE

PRIORITY CLAIM

This application claims the benefit of French Application No. 02/01782, filed Feb. 13, 2002. The disclosure of the above application is incorporated herein by reference.

BACKGROUND OF THE INVENTION

1. Technical Field

This invention relates to a moving-coil electrodynamic motor, and more particularly, to a moving-coil electrodynamic motor for a loudspeaker. This invention also relates to a loudspeaker and a pole piece.

2. Related Art

To limit harmonic distortion on reproduction, loudspeakers should have good response linearity. Linearity is obtained particularly when a coil intercepts a homogeneous magnetic field flux during movement of the coil. The distance of a maximum linear displacement of a coil may be referred to as a maximum linear excursion or $X_{max}$, which can be abbreviated to $X_M$. Linearity also may be obtained by at least two other methods. One method involves making the coil a homogeneous winding with a considerable height (along the front-rear axis of the coil movement) greater than the height of the gap where the coil is disposed. In this way, as long as a coil remains entirely in the gap, force and current flowing in the coil remain proportional. This configuration, known as a long coil configuration, is suitable for boomers. The second method relates to reducing the height of a coil relative to the height of a gap. This configuration, known as a short coil configuration, is often used for tweeters and may be used for mediums.

Despite improvements to reproduce characteristics of loudspeakers having a moving-coil electrodynamic motor, asymmetry of magnetic field toward both ends of a gap undermines linearity and eventually affects the maximum linear excursion of a coil. In addition, loudspeakers have sources of sound distortion, such as complex electromagnetic phenomena created by variable electric fields, such as displacement of conductors in the magnetic field, modulation of the static magnetic field of a magnet in a gap by variable current flowing a coil, and a coil "DC shift" and generation of Foucault current. Accordingly, there is a need for a loudspeaker system that overcomes the foregoing drawbacks.

SUMMARY

The invention relates to a moving-coil electrodynamic motor for a loudspeaker. The moving coil electrodynamic motor includes at least one magnet having two magnetic poles, a front pole piece and a rear pole piece having the magnet disposed therebetween. A gap is defined on a first side by a first edge of the front pole piece and on a second side by a second edge of the real pole piece. The front pole piece and the rear pole piece enclose a magnetic field of the magnet in the gap, where the gap is configured to be split into two zones. The gap has at least one edge.

The motor further includes a moving coil and a groove. The moving coil may be formed by winding an electric conductor to form a specific number of turns. The electric conductor is connected to an acoustic diaphragm. The moving coil is disposed in the gap and the turns are perpendicular to the magnetic field so that when a current flows through the coil, the coil moves along a front-rear axis. The groove is formed on the edge of the gap and is disposed substantially parallel to the coil. The edge of the gap includes a first surface having height E1. The first surface is separated from a second surface having E2 by the groove having height C. The groove forms a zone, which is receding from the first surface and the second surface. The first surface is located rearward, and the second surface is located forward relative to the groove. Height E1 relates to a first gap space of a rear magnetic field B1 and height E2 relates to a second gap space of a front magnetic field B2. The coil is configured to have height HB less than or equal to height E1+C+E2 of the split gap.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
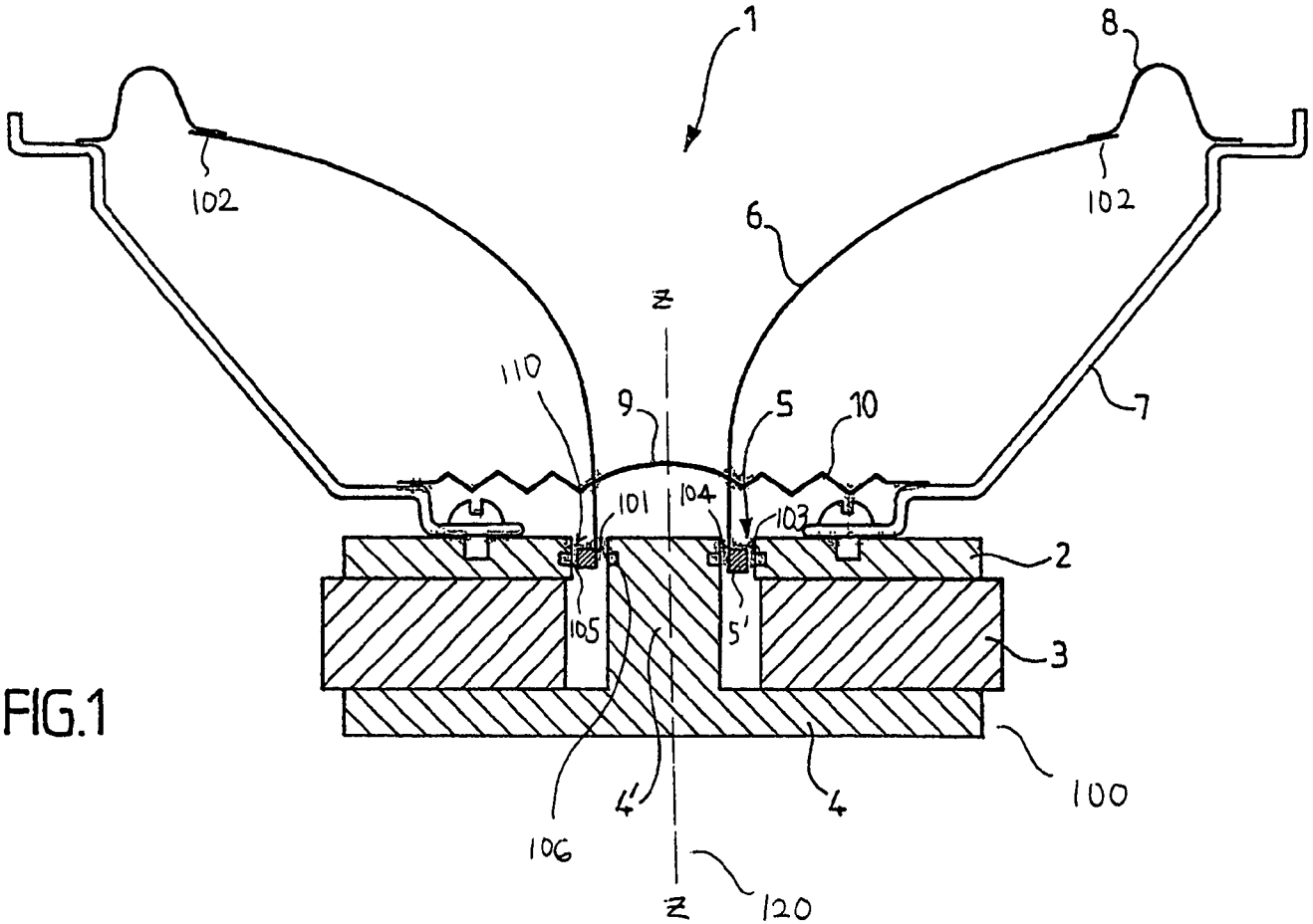
FIG. 1 shows a loudspeaker including a motor having a cone-shape diaphragm and a crown magnet.

Loudspeakers generally include a motor having a magnet. A magnet has two poles that are configured to produce a magnetic field. The magnetic field is enclosed in a gap between two pole pieces. Each pole piece is related to one of magnet poles. The pole pieces are generally made of soft iron or low carbon content steel. The gap is a free space zone where the magnetic field is substantially constant. The gap is also where the pole pieces are closest to each other. A moving coil is formed by turns of a conductive wire and disposed in the gap. When current flows through the coil, the coil is subject to magnetic field and force is generated which results in movement of the coil in accordance with vector formula $F=B \cdot I \cdot l$ (where B is the intensity of induction or magnetic field, I is the intensity of current and l is the length of conductors subject to magnetic field). A minimum width of the gap depends on the thickness of the coil because the coil needs to move without interference in the gap. Accordingly, sufficient clearance of the gap is needed to allow free movement of the coil. Other factors such as constraints of manufacture, expansion of materials, etc. should be taken into account to determine the minimum width of the gap.

In order to convert force moving the coil into an acoustic pressure wave, the coil may be connected to an acoustic diaphragm that can move the air in its enclosure. The structural and dimensional characteristics of a diaphragm depend upon loudspeakers using such diaphragm. A motor has a circular symmetry with respect to a central axis extending from front to rear and the coil also is made of a circular winding of turns. Thus, the diaphragm may be circular, but an elliptical diaphragm is also possible.

For reproduction, the frequency range of audible sound for human ear and even somesthetic sound having the lowest frequency is generally very wide, for example, approximately between 20 Hz and 20 kHz. Because the sound wavelengths vary greatly on this wide frequency range, a single loudspeaker may not be able to reproduce sound having good reproduction characteristics, such as less distortion, high sensitivity and directivity across the entire frequency range. Accordingly, loudspeakers have been configured with reduced frequency range to obtain good reproduction characteristics over that reduced range. Specifically, loudspeakers are configured to be adapted to low frequencies, high frequencies, and intermediate frequencies, and these loudspeakers are known as boomers or woofers, tweeters, and mediums, respectively.

A diaphragm used for boomers has an extended surface and responds to a large movement or excursion, whereas a diaphragm of tweeters has a reduced surface. Difference in diaphragm sizes between boomers and tweeters led to different technical constructions of a motor. A general description of different types of loudspeakers is found in "Techniques of loudspeakers and speakers (Techniques des hautparleurs & enceintes acoustiques)," written by Pierre Loyez and published by DUNOD.

For a boomer, a diaphragm has a cone shape and a motor magnet has a ring (crown) shape and is generally a ferrite type. A gap is formed between an inner edge of a front pole piece disposed on a front pole of the magnet and a central core piece of a rear pole piece. A magnetic field is enclosed in the gap. The central core piece extends in a forward direction from a rear pole piece that is related to a rear pole of the magnet. One end of the diaphragm is connected to a coil and the other end of the diaphragm is connected to one edge of a first suspension. The first suspension is disposed in a peripheral area of the motor and secured to a rigid frame that is fixed to the motor. A second suspension or spider is disposed in the gap and allows the coil to be secured axially during its front-rear movements. Accordingly, the coil remains free, without lateral friction, in the gap. This double guidance structure by the first suspension and the spider allows the coil to avoid interference even in the case of large excursions of the coil. A core cover or dust cover can be used at the center of the cone.

For a tweeter, a diaphragm may have a dome shape, which may be concave or convex. A core magnet may have a shape of a metal cylinder and is made of neodymium, iron, or boron. The core magnet is disposed on a rear pole piece or a yoke, which has a first magnetic pole. The magnet may be also a ferrite type or a metal alloy type such as Ticonal. The rear pole piece has a lateral protrusion from rear to front and encloses a magnetic field in a gap by the lateral protrusion. A front pole piece is a plate or a pellet and is disposed adjacent a second magnetic pole. An edge of the front pole piece defines the gap along with the yoke. A peripheral suspension of the dome holds a moving coil along a front-rear axis during movements of the coil inside the gap without the lateral friction. This structure is known as a single guidance structure. Accordingly, a tweeter has a single guidance structure, as opposed to a double guidance structure for a boomer as previously described.

A medium combines the characteristics of a boomer and a tweeter described above. Specifically, a medium may have a dome shaped diaphragm and a ferrite ring magnet. The magnetic field may be enclosed in a gap by a protrusion of a rear pole piece toward front.

As previously stated, it is possible to classify loudspeakers according to the structure and material of a magnet or shape of diaphragm used therein. The structure of a magnet may be either a solid core magnet or a magnet having a central opening. For a magnet having the central opening, a crown or ring magnet is disposed outwardly relative to a central axis and a coil. For a core magnet, a coil is disposed outwardly relative to a magnet. For a crown magnet, a coil may be disposed inwardly relative to the magnet toward the center. A magnet may be a ferrite type magnet; a metal alloy type magnet such as Ticonal, Alnico or ALCOMAX® (aluminum, nickel, titanium, cobalt, iron); or alternatively or additionally, a rare earth magnet (samarium, cobalt, neodymium, iron, boron). The shape of the diaphragm may be dome, cone, or mixed shape such as W shape.

FIG. 1 shows a loudspeaker 1 including an electrodynamic motor 100. The motor 100 has a crown (ring) magnet 3, and a cone-shaped diaphragm 6. The loudspeaker 1 is adapted to reproduce low frequencies of sound, i.e., a boomer. The crown magnet 3 may be a ferrite type having two opposed magnetic pole surfaces. The crown magnet 3 rests on a rear pole piece (a real plate) 4 facing a rear pole surface. The rear pole piece 4 has a protrusion 4' extending through a central opening of the ring magnet 3. A front pole piece 2 is disposed on a front pole surface of magnet 3. This front pole piece 2 has a crown or ring shape with a central opening like magnet 3. A gap 110 is formed between the inner edges 103 of the front pole piece 2 and a corresponding zone 104 of the protrusion 4' of the rear pole piece 4. The two pole pieces 2, 4 are, for example made of soft iron.

The inner edges 103 of the pole piece 2 include a grove 105. In the gap zone, another groove 106 may be formed on a front protrusion 4' of the rear pole piece 4. Splitting the gap 110 relative to the groove 105 results in two zones having substantially equal height and defining a first field zone and a second field zone in the gap, such as zones 36, 37 described in conjunction with FIG. 4. The first field zone is more proximal to a rear side of the motor 100 than the second field zone. The shape of the split gap may be adapted to a specific structure that optimizes operations of a loudspeaker. In particular, heights of the first and second field zones may be different. Also, the grooves 105, 106 may be or may not be symmetrical. Alternatively, only one of grooves 105, 106 may be formed. In FIG. 1, the edges 103 of the pole piece 2, which are a starting point of enclosing magnetic field in the gap 110, are shown to have a reduced thickness compared with other dimensions. The thickness of the edges 103 of the pole piece 2 corresponds to the height of the gap 110. Different values for the height of the gap 110 may be available, as will be described below. The height of gap 110 changes depending on the material used and the magnetic field generated by magnet 3 to avoid a magnetic saturation of such material.

A coil 5 includes turns of an electric conductor and is disposed in the gap 110. The coil 5 is homogeneous because there is the same number of turns at each level along a height of the coil 5. As a result, the force generated by a given magnetic field is constant at every point of the height of the coil 5. As shown in FIG. 1, the height of the coil 5 is less than the height of the gap 110. At rest, in the absence of current, the coil 5 is located at the same level with the groove 105 and a front end of the coil 5 intercepts a front magnetic field and a rear end of the coil 5 intercepts a rear magnetic field. At rest, disposition of the coil 5 may be or may not be symmetrical with respect to the groove 105 along a front-rear axis (Z-Z) 120. When current is present, the coil 5 moves along the front-rear axis (Z-Z) 120. If the coil 5 is disposed symmetric to the groove 105, the coil height intercepting the rear magnetic field is equal to the coil height intercepting the front magnetic field. By contrast, if the coil 5 is not symmetrically disposed to the groove, the coil heights intercepting the rear magnetic field and the front magnetic field may be different from each other.

A first end 101 of the cone-shaped diaphragm 6 is attached to a coil support 5' that forms part of the coil 5 A second end 102 of the cone shaped diaphragm 6 is attached to a peripheral suspension 8. The peripheral suspension 8 is secured to a rigid frame 7, which is secured on the motor 100. An inner suspension or "spider" 10 holds the first end 101 of the cone-shaped diaphragm 6 that is coupled to the coil 5, so that the coil 5 is not rubbed against other elements of the motor 100 during front-rear movements. A dust cover 9 is disposed towards a center of the cone-shaped diaphragm 6.

Figure 2:
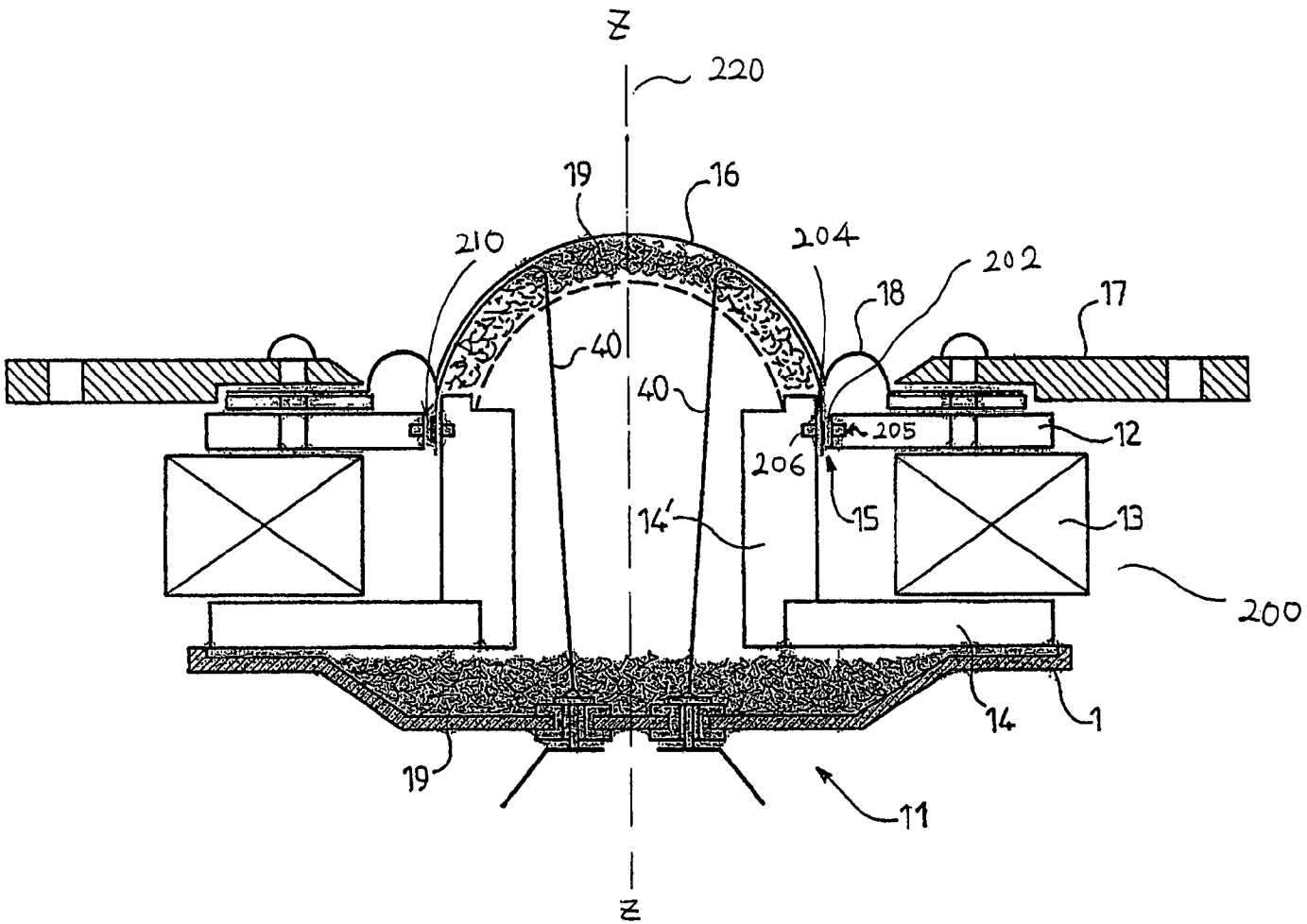
FIG. 2 shows a loudspeaker including a motor having a dome-shape diaphragm and crown magnet.

FIG. 2 shows a loudspeaker 11 including a ring (crown) magnet 13, a front pole piece 12, and a rear pole piece having two parts 14, 14'. However, since the frequency range to be reproduced is in the middle part of sound spectrum, a diaphragm 16 has a dome-shape that is peripherally connected to the coil 15 disposed in a gap 210. The magnet 13 may be a ferrite type magnet. The dome-shaped diaphragm 16 and the coil 15 are connected to a chassis 17 by a peripheral suspension 18. Absorbent materials 19 are disposed to reduce damping of the system. A protrusion 14' of the rear pole piece 14 provides an added ring, which is open at its center for the passage of connecting leads 40 to the coil 15. The connecting leads 40 pass through the chassis 17 of a frame. The rear pole piece 14 and the front pole piece 12 may be ring shaped, are disposed at each pole of the magnet 10 and may be made of metal, such as soft iron. Inner edges 202 of the front pole piece 12 define the gap 210 and include a groove 205. The groove 205 splits the gap 210 into two zones. An edge 204 of the protrusion 14' of the rear pole piece 14 also defines the gap 210 and has a groove 206. The groove 205 can split the gap 210 into two zones having substantially equal height in order to define a first field zone and a second field zone of the gap as zones 36, 37 in FIG. 4 below. The first field zone is more proximal to a rear side of the motor 200 than the second field zone. Alternatively, the two zones may not have the equal height. The shape of the split gap may be adapted to specific structure that can optimize an operation of the loudspeaker. In particular, heights of the first and second field zones may be different. Similarly, where grooves 205, 206 are present on each of the two edges 202, 204 defining the gap 210, the grooves 205, 206 may or may not be symmetrical. Alternatively, only one of the grooves 205, 206 may be formed.

Figure 3:
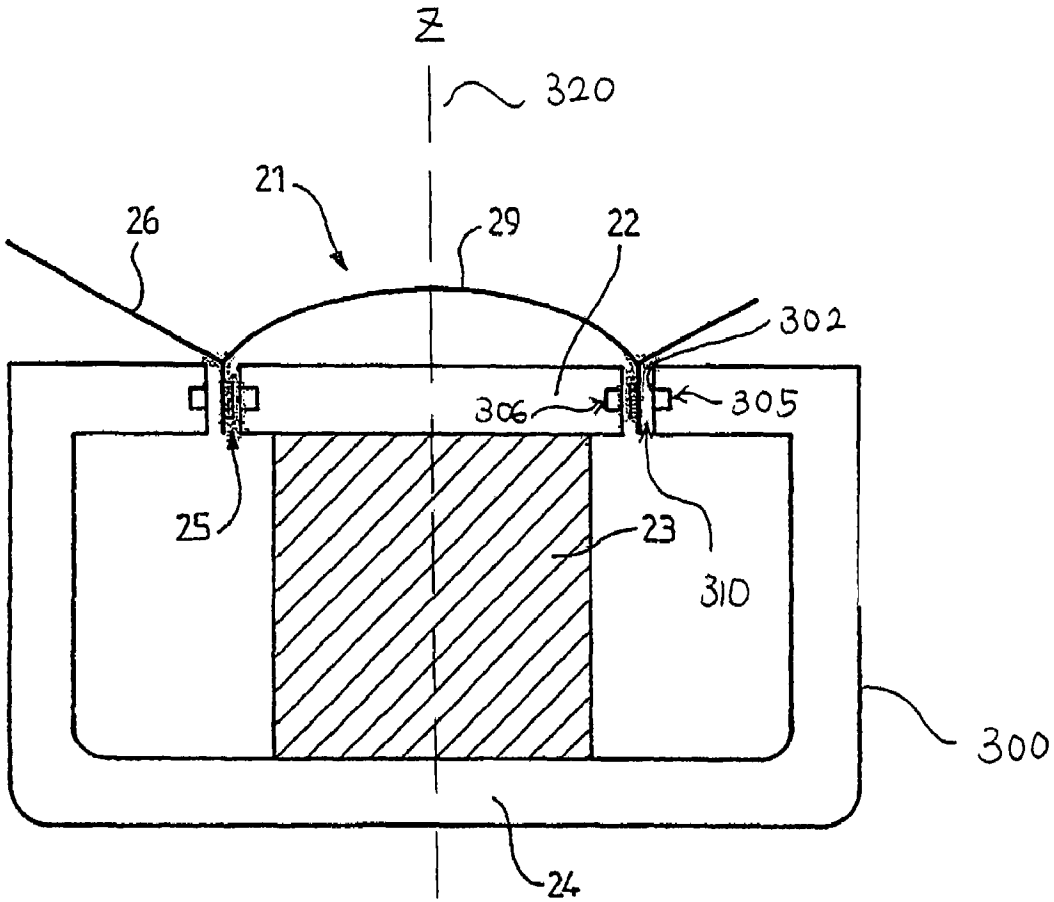
FIG. 3 shows a loudspeaker including a motor having a core magnet.

FIG. 3 shows another loudspeaker 21 having a moving-coil electrodynamic motor 300. Referring to FIG. 3, a magnet 23 is a core magnet, which is disposed at the center of the motor 300. The magnet 23 may be a pellet or a cylindrical ring and may be a rare earth type magnet. Alternatively and additionally, the magnet 23 may be made of ferrite; aluminum, nickel, titanium, cobalt and iron based alloy; Ticonal, Alnico or ALCOMAX®. The magnet 23 includes two poles and rests on a rear pole piece or yoke 24. The rear pole piece 24 encloses a magnetic field across a gap 310 on edges 302 of a front pole piece 22. A moving coil 25 is disposed in the gap 310. The gap 310 is split in two zones by a groove 305 formed on the edge 302 of the front pole piece 22. Symmetrically, a groove 306 is also made on the rear pole piece 24. Alternatively, the grooves 305, 306 may be omitted, or the gap 310 may be split in two zones only on one side. Further alternatively, the motor 300 may be a central opening.

In FIGS. 1, 2 and 3, the motor, the magnet, the two pole pieces, and the coil have a circular symmetry relative to a central revolution axis 320 that extends from a front direction to a rear direction. However, non-circular structure is also available.

Figure 4:
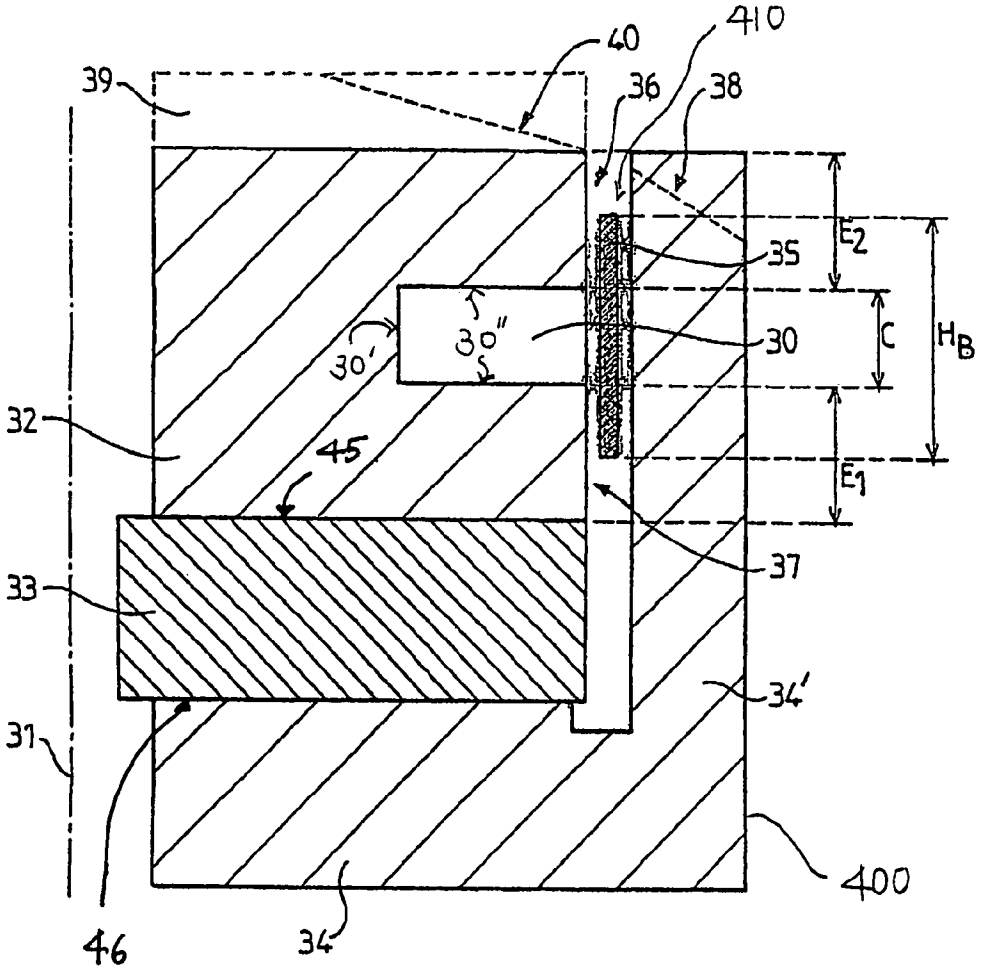
FIG. 4 shows an enlarged view of a loudspeaker.

FIG. 4 shows structure of a motor 400 in detail. Only the right-hand part of the motor 400 is shown along a front-rear axis of symmetry 31. A magnet 33 is a core magnet which has a central opening along the axis 31. Through this central opening, elements of the motor 400 may be connected, for example, by injecting a plastic material in a hot state or a resin. The central opening allows contained air to pass through and decompress. Alternatively, the magnet 33 may be solid without the central opening as shown in FIG. 3. The magnet 33 has a first front pole surface where a front pole piece (or field plate) 32 is placed. The front pole piece 32 has a center opening but alternatively, as in FIG. 3, it may be solid without the opening.

The magnet 33 has a second pole surface 46 opposite to the first pole surface—45 and where a rear pole piece or yoke 34 is disposed as shown in FIG. 4. The rear pole piece or the yoke 34 has a forward protrusion 34' designed to enclose magnetic field in a gap 410. The rear pole piece 34 is open toward its center, but alternatively, as in FIG. 3, it may be solid. The gap 410 is defined by an edge of the front pole piece 32 and the corresponding surface zone of the protrusion 34' of the rear pole piece 34, which is opposite to the edge of the front pole piece 32. A groove 30 may be formed on the edge of the front pole piece 32 to split the gap 410 into two field zones. The groove 30 has a height C.

The groove 30 is formed on the edge of the front pole piece 32 so that height E1 of a rear field zone 37 is substantially equal to height E2 of a front field zone 36. Alternatively, these heights by optimization computing methods may be different depending on the materials and structure used. The groove 30 is internally surrounded by an electrically conductive material, for example, copper or graphite carbon. A base wall 30' of the groove 30 is round and connections between the base wall 30' and side walls 30" (top and bottom walls here) of the groove 30 are round. In fact, a ridge or a cornered connection on surfaces of a magnetized pole piece creates singular points in distribution of magnetic field, which may cause an adverse effect.

To reduce costs, the front pole piece 32 having the groove 30 may be formed from at least two elements. A two piece groove 30 makes it easier to place a closed ring of conductive material in the groove 30. For example, the front pole piece 32 with the groove 30 is made of two elements, a first element corresponds to the front field zone 30 of (height E2) and a second element corresponds to the groove 30 and the rear field zone 37 of (height E1). The conductive ring is then inserted in the second element at the groove level, and then the first element is placed on this assembly. Various arrangements to facilitate disposition of the ring both in the front pole piece and the rear pole piece may be possible. In particular, the two elements may, for example, be identical or substantially identical to height E1+C/2 and E2+C/2 respectively.

A coil 35 is disposed in the gap 410 and its height is preferably less than height of the gap 410. Alternatively, the height of the coil 35 may be equal to the height of the gap. A coil support forming a part of the coil 35 (not shown) is normally attached forwardly to a diaphragm having a cone or dome shape depending on types of loudspeakers. At rest, the coil 35 is disposed at the same level with the groove 30. The motor 400 is configured that the height of the front part of the coil 35 intercepting the front field zone 36 is substantially equal to the height of the rear part of the coil 35 that intercepts the rear field zone 37. Thus, E1=E2=E, and a height $H_B$ of turns of the coil 35 is preferably equal to E+C, which permeits a maximum excursion $X_M$ of the coil 35 with a good linearity to +/− ((E/2)+C) relatively to the rest position of the coil 35. At rest, the rear end of the turns of the coil 35 is at the same level of the mid-height of E1 and the front end of the turns of the coil 35 is at the same level of the mid-height E2.

As previously stated, optimization tools such as MAGNET® or OPERA® have enabled the motors to be adapted to specific range of frequency. For example, heights E1 and E2 may be different and therefore, the groove is 30 disposed offset with respect to the mid-height of the gap. The width of the gap may be different in the rear field zone 36, the groove 30, or the rear field zone.

FIG. 4 further shows an additional structure in broken lines. The front pole piece 32 may protrude forwardly (39). The protrusion 34' of the rear pole piece 34 may not extend in the same way as the protrusion 39, and the front field zone 36 may be only slightly modified. However, the protrusion 39 has a frusta-conical edge 40 to reduce modification of the front field zone 36 resulting from the protrusion 39. Similarly, the protrusion 34' of the rear pole piece 34, may have a front free end 38 and the protrusion 34' is generally frusta-conical. Alternatively or additionally, the modification to the protrusions 34' and 39 may be made in combination. Due to the modification of the protrusion 34', a forward end of the protrusion 34' may not exceed a front end of the front field zone 36. The free end 38 may not reach the front end of the front pole piece 32. Alternatively or additionally, the free end 38 may end at the same level as E2. This split gap structure with a front pole piece having an edge and a groove is adapted to various types of loudspeaker (dome or cone) as was described in connection with FIGS. 1 to 3.

Figure 5:
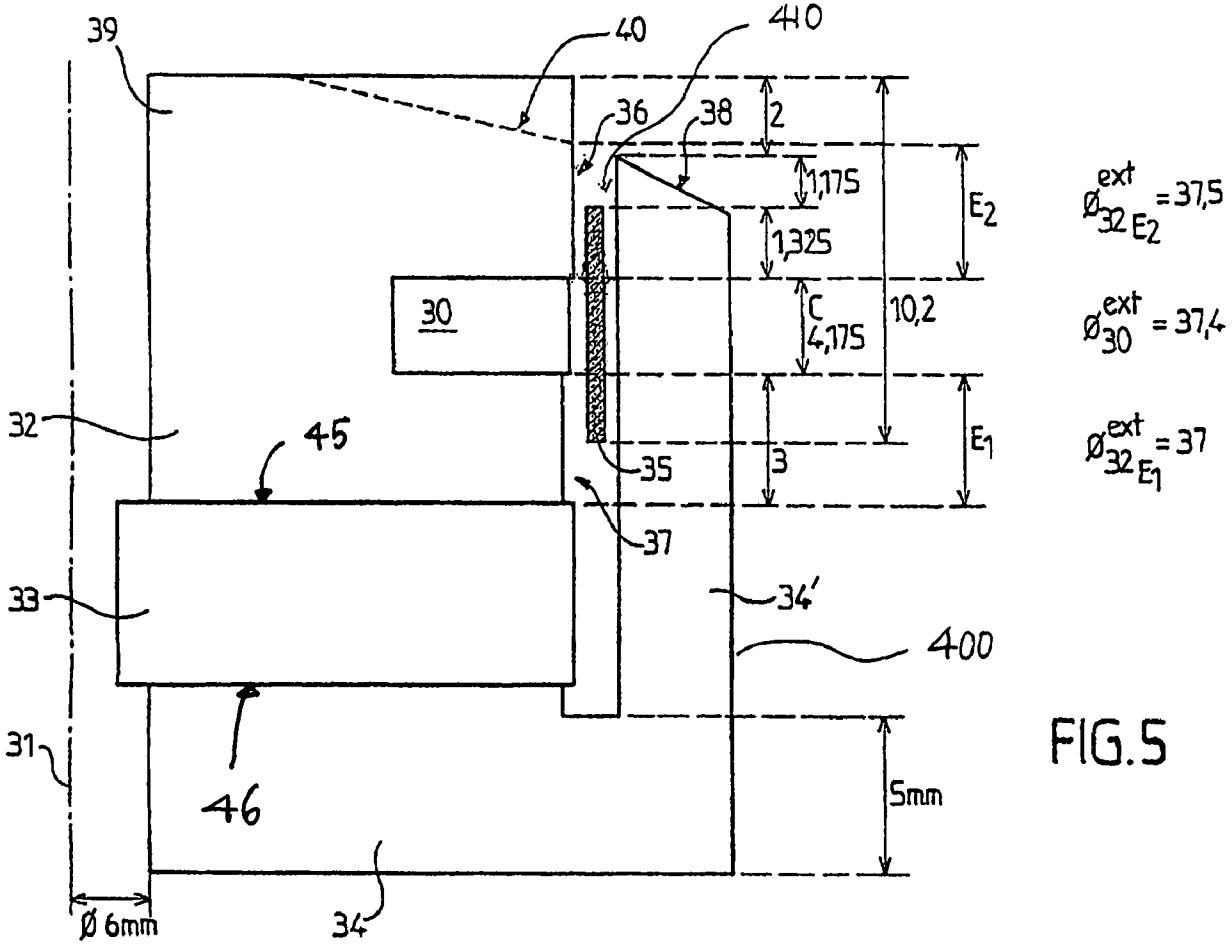
FIG. 5 shows a detailed view of an optimized loudspeaker of FIG. 4.

FIG. 5 shows optimization of the motor 400 in FIG. 4. In FIG. 5, the protrusion 39 of the front pole piece 32 may be changed to have frusta-conical shape 40 and thus, the width of the gap may not be the same. Specifically, the width of the gap may be greater toward rear than front so that the magnet 33 is closer to the rear field zone 37 than to the front field zone 36. Alternatively or additionally, one edge or both edges defining the gap 410 may be inclined to produce the same effect, unlike the structure shown in FIG. 5 where edges defining the gap 410 are parallel to each other. A coil that is not homogeneous may be used to create differences in magnetic fields depending on the gap zone. The product B.l can be constant at every point of the coil 35 both in static state and during its movements. Reduced forces (the number of turns decreasing at one end of the coil), may be compensated by adding equivalent forces (the number of turns increasing at the other end of the coil). Thus, any type of coil, i.e., homogenous or not, may be used by adjusting magnetic field according to the height of the gap.

Figure 6:
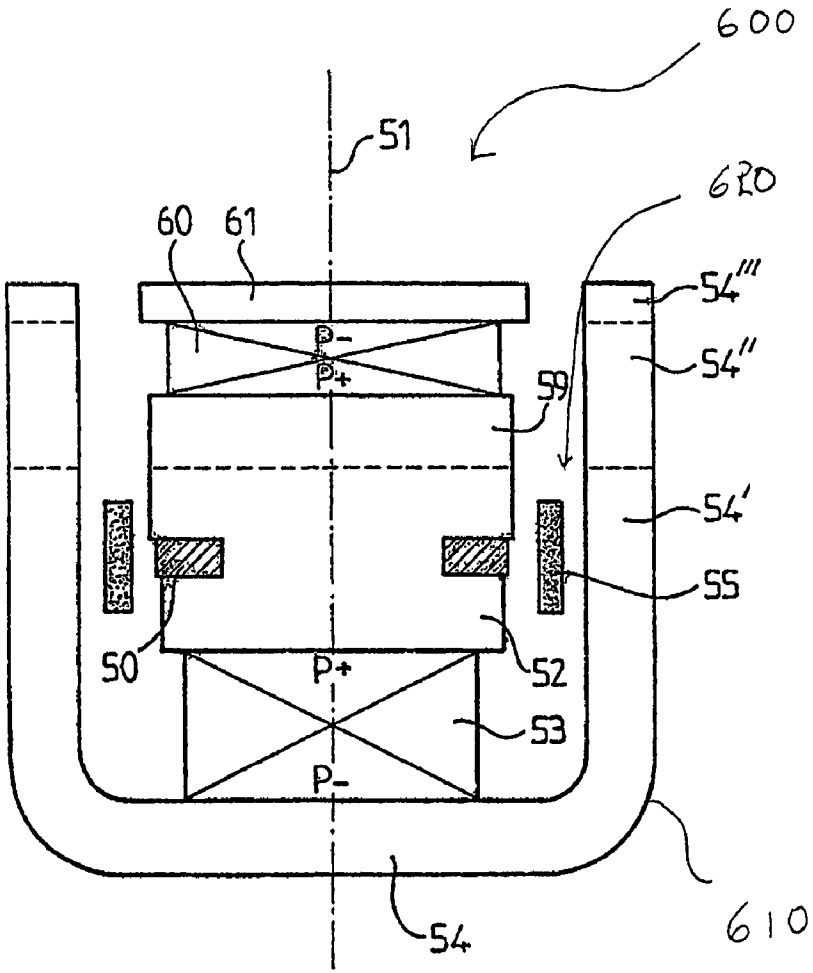
FIG. 6 shows a loudspeaker having reduced magnetic loss.

FIG. 6 shows a loudspeaker 600, which achieves low magnetic loss. A loudspeaker 600 may be suitable, in particular, for appliances in which magnetic field likely disturbs operations, such as CRT of a television set, a magnetic resonance measurement device (RMN), or for articles having the risk of "demagnetizing" such as a computer disk or magnetic tapes of a cassette for a cassette player or a magnetic track payment or transportation card. A motor 610 shown in FIG. 6 has a core magnet 53. Additionally, the motor 610 may have a counter-magnet 60 on a front protrusion 59 of a front pole piece 52. Using a counter-magnet 60 improves efficiency because it enables magnetic field lines to be better channeled in a gap 620 where a coil 55 is located. At rest, the coil 55 intercepts by its rear part a rear magnetic field and by its front part, a front magnetic field. The rear magnetic field and the front magnetic field are disposed in the gap 620 split by a groove 50. Main magnetic field of the motor 610 is generated by the magnet 53. P+ and P− indicate two magnetic poles having opposite polarity (north and south or vice-versa) of each magnet 53 to show that magnet 53 and counter-magnet 60 are oriented in opposition. The front and rear pole pieces 52, 54, the magnet 53 and the counter-magnet 60 are symmetric with respect to a central axis 51. The motor 610 circularly revolves. Alternatively, a central opening may be located at the center of the motor. A rear pole piece 54 or a yoke encloses magnetic field generated by the magnet 53 in the gap.

As shown in FIG. 6, the magnet may be a core magnet. This core magnet assembly includes a forward protrusion 54', 54" and 54'". A pellet 61 made of ferromagnetic material disposed in front of the counter-magnet 60 also enables magnetic field to be enclosed by an end of protrusion 54'" of the rear piece pole 54. As a result, loss of magnetic field may be substantially reduced. The space between an edge of the pellet 61 and a corresponding edge of 54'" is smaller than the minimum width of the gap because only the coil support (not shown) is disposed at this level. However, if coil excursion is very large until it reaches the level of the pellet 61, sufficient space should be left for the coil 55 to be able to move in the gap without any interference. In one example, the front pellet 61 and the protrusion 54'" of the rear pole piece 54 may be omitted. In another example, the front protrusions 59 of the front pole piece 52 may be omitted and the counter-magnet 60 is disposed directly on the front pole piece 52. Alternatively or additionally, the parts 54'" and 54" of the rear pole piece 54 may be omitted. The foregoing examples may be combined with one another.

The counter-magnet 60 makes magnetic field in the gap 620 symmetric or equal between a rear field zone having height E1 and the front field zone having height E2. As a result, the difference in the width of the gap between the rear field zone and the front field zone can be reduced and the motor optimized. In fact, the rear field zone, which is closer to the magnet 53, is subjected to greater magnetization than the front field zone. In the absence of the counter-magnet 60, the front field zone has a greater staggering magnetic field lines. For the same reason, during optimization, the gap in the rear field zone may need to be enlarged more compared with that in the front field zone. By contrast, the counter-magnet 60 allows magnetic field lines to be better channeled in the gap 620 and the magnetization is better distributed between the two field zones. Thus, depending on the degree of optimization selected or presence of the counter-magnet 60, width between the front and rear zones of the gap may differ. The height of the gap is measured relative to the central axis 51, which is substantially parallel to the movement of the coil 55, and the width of the gap is the difference separating the front pole piece edge and the corresponding rear pole piece edge. Although FIG. 6 describes the motor with the core magnet, a crown magnet also may be used. Likewise, a groove may be formed on each of the two edges of the gap or may be disposed on the other pole piece, i.e., the rear pole piece 54 instead of the front pole piece 55.

As described above, an electrodynamic motor coil includes a moving coil formed by a predetermined number of turns of an electric conductor. The electric conductor is connected to an acoustic diaphragm. A motor includes at least one magnet having two magnetic poles and disposed between a front pole piece and a rear pole piece. Two poles have opposite polarities. The front pole piece and the rear pole piece enclose a magnetic field formed from the magnet in a gap. The gap may be defined on a first side by a first edge of the front pole piece and on a second side by a second edge of the rear pole piece. A moving coil disposed in the gap turns perpendicularly to the magnetic field so that when current flows the coil, the coil moves along a front-rear axis.

The gap may be split into two zones and at least one of edges of the gap may have a groove. The groove is disposed substantially parallel to the turns and the edge has a first rear surface having height E1 separated from a second front surface having height E2 by the groove having height C. The groove forms a zone receding from the first surface and the second surface. The first rear surface defines a first gap space of rear magnetic field B1, and the second rear surface defines a second gap space of front magnetic field B2. The coil has a height $H_B$ less than or equal to height E1+C+E2 of the split gap.

The groove internally has a continuous and closed ring of an electrically conductive material along its walls. The ring of conductive material may occupy all or part of the groove. Width of the gap may be or may not be identical along the height of the gap. The first surface may recede from the second surface. Similarly, the groove may be disposed on an edge of the front pole piece and an edge of the rear pole piece. The groove may be or may not be symmetrical with respect to the gap. Winding of the coil may be or may not be homogeneous. Height E1 may be or may not be equal to height E2.

At rest, the coil is disposed facing the groove and intercepts by a first end with NB1 turns, the rear magnetic field B1 and by a second end with NB2 turns, the front magnetic field B2. Thus, the product B1·NB1 is substantially equal to the product B2·NB2 along the height of the coil, where E1 is substantially equal to E2, the winding of the coil is substantially homogeneous and the coil has a height $H_B$ that is substantially equal to E1+C or E2+C or E1/2+C+E2/2 (an average of two previous formulae).

The gap has a width that is substantially constant at least along heights E1 and E2. The maximum linear excursion $X_M$ of the coil on either side of the rest position is substantially equal in absolute value to (E1/2)+C or (E2/2)+C or an average of the two. The coil is substantially homogeneous and E1=E2=E and $H_B$=E+C. The maximum excursion $X_M$ of the coil on either side of the rest position is in absolute value $X_M$=(E/2)+C. The groove may be disposed on the first edge of the front pole piece and on the second edge of the rear pole piece. The front pole piece protrudes forwardly, and the rear pole piece does not protrude forwardly in response to the protrusion of the front pole piece.

Free end of the rear pole piece adjacent the gap zone may be conic. Further, the front protrusion of the front pole piece may be conic toward its peripheral edge. The motor may include at least one counter-magnet toward front. The counter-magnet has the poles oriented in the opposite way to the orientation of the poles of the magnet. The motor also may include a pellet made of a ferromagnetic material on the counter-magnet and the rear pole piece may protrude forwardly. The forward protrusion of the rear pole piece may be as far at maximum as the top level of the pellet. The ferromagnetic material is soft iron.

The motor is symmetric with respect to a central axis extending from front to rear and circularly revolves. Edges of the front and the rear pole pieces may be straight and parallel to one another, and alternatively or additionally, they may be straight and inclined. The side of the gap without the groove is straight and substantially parallel to the front-rear axis. The first field zone (height E1) is substantially equal to the second field zone (height E2) so that the width of the gap is substantially constant along its height. The width of the gap at the point having the first rear magnetic field B1 is larger than the width of the gap at the point having the second front magnetic field B2.

The magnet may be a core magnet, and the front pole piece may be a substantially flat pellet. The rear pole piece may be a yoke having a U shape. The yoke may have a base on which the magnet rests. The split gap is defined by the edge of the pellet and the upright edge of the yoke. E1 and E2 each may be approximately 3 mm, C may be approximately 4.175 mm, the protrusion of the front pole piece may be approximately equal to 3 mm and $H_B$ is approximately 7.025 mm. Free end of the rear pole piece adjacent gap zone may be lowered with respect to a front end of the front pole piece having height E2. For example, the free end of the rear pole piece may be lowed by about 0.5 mm. The width of the gap in the rear zone defined by E1 is larger than the width of the gap in the front zone defined by E2. The width of the gap in the zone of the groove with the electrically conductive material is intermediate value compared to the width of the gap at E1 and E2.

The following is an example of a motor incorporating concepts disclosed above. One of skill in the art will recognize that many other examples are possible based on the teachings here. A diameter of the magnet may be 37 mm and a thickness may be 6 mm. The edge E1 of the gap is on a diameter of 37 mm and the edge E2 of the gap is on a diameter of 37.5 mm. The edge C of the material is on a diameter of 37.40 mm. The inner edge of the groove is on a diameter of 22.3 mm. The edge of the gap on the rear pole piece is on a diameter of 40.7 mm. The inner edge of the coil is on a diameter of 38.0 mm and the outer edge of the coil is on a diameter of 40.2 mm. The clearance for the coil with respect to each of the two edges of the gap is about 250 μm. The conic free end of the rear pole piece adjacent the gap zone is approximately 27.5° with respect to the horizontal. The outer edge of the rear pole piece is on an approximate diameter of 50 mm. The dimensions described above are by way of example only and various dimensions are possible due to constraints of manufacture, machining, molding, etc.

The magnet may be a crown magnet. The front pole piece may be a substantially flat ring having an inner peripheral edge toward the center of the crown. The rear pole piece is formed by a rear plate on which the magnet rests and a central core extending from rear to front. The split gap is defined by the inner edge of the ring and the central core zone. Electrically conductive material is selected from gold, silver, copper, aluminum, graphite carbon or their combination. Preferably, the conductive material is made of copper.

Conductive material is electrically insulated from a grooved pole piece. Alternatively or additionally, the conductive material may not be electrically insulated from the material of its grooved pole piece. The electrical insulator of the conductive material has a high thermal conductivity coefficient. The base of the groove has two connecting zones that are round at the top and bottom walls of the groove. The coil includes a coil support. The coil may be homogeneous over its height. Alternatively, the coil may not be homogeneous over its height, and two zones of turns may be separated by a space. The turns of the coil are conductive tracks deposited on the coil support.

A magnet may be a core magnet and have a central opening. A front pole piece of the central opening core magnet also has the central opening. The counter-magnet of a core magnet with a central opening may have another central opening. The pellet of a counter-magnet with the central opening also has a central opening. Alternatively, the pellet may be a substantially continuous and made of a solid flat part. The front pole piece and the rear pole piece are made of a one piece material. Alternatively or additionally, it is also possible that the front pole piece and the rear pole piece may be made from combining at least two elements.

The motor described above may be suitable for a moving-coil electrodynamic loudspeaker. A pole piece for a motor described above may be modified. In particular, the gap is split into two zones and at least one of the peripheral edges have a first surface having height E1 separated from a second surface having height E2 by a groove having height C. The groove forms a zone receding from the first surface and the second surface. The groove may be on the front pole piece and/or on the rear pole piece.

A moving-coil electrodynamic motor described herein has improved linearity. As a result of the split structure of the gap, it is possible to balance forces to which a coil is subject during its movements and compensate any discrepancy in forces between two zones defined by E1 and E2. For example, when force created by a field B1 decreases because the number of turns exposed decreases, the coil moves forwardly. An equivalent force created by a field B2 is added because more turns enter the field B2. Accordingly, the product B.l is adjusted so that there is effective compensation on movement of the coil. Specifically, the fields B1 and B2 may be identical or different depending on whether a coil is homogeneous or not. This configuration particularly reduces distortions of odd order, which may be considered the most unpleasant to ears. This configuration also reduces DC shift effects. Furthermore, the motors may be extremely compact, while having a large excursion of the moving coil.

The use of a counter-magnet increases efficiency of a motor, and a loudspeaker with low magnetic losses may be particularly adapted to television applications where magnetic field should be reduced to avoid distortions of images produced by cathode ray tubes. Also, by the use of computing tools for modeling magnetic and electromagnetic fields, it is possible to optimize a basic configuration to obtain even better results while reducing materials to be used. Volumes may be determined so as to be at the bottom limit of magnetic saturation. With optimization, the width of the gap may be different between the rear field zone defined by E1 and the front field zone defined by E2, because E1 is closer to the magnet than E2. Similarly, a front protrusion of the rear pole piece may be shortened with respect to the front end of E2 which is opposite thereto. The loudspeaker can substantially reduce a distortion, for example, approximately three times, in a low-frequency range compared with conventional loudspeakers.

Any combination of different types of a magnet is possible, regardless of magnet shape (crown, core, etc.), magnet material (ferrite, metal, rare earths, etc.) and diaphragm type (dome, cone, etc.). The invention may use structure for reducing magnetic radiation, such as shielding and one or more counter-magnets. Sensors for providing information to an amplifier to which the sensors are connected may be used to control the amplifier.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

What is claimed is:

1. A moving-coil electrodynamic motor for a loudspeaker comprising:

a magnet having two magnetic poles;

a first pole piece and a second pole piece defining a gap and enclosing a magnetic field in the gap where the magnet is disposed between the first pole piece and the second pole piece and where the gap includes a first zone and a second zone;

a moving coil including a winding of a specific number of turns of an electric conductor and disposed in the gap, where the turns are perpendicular to the magnetic field so that the coil moves in response to a current along a front-rear axis; and, a groove disposed substantially parallel to the turns and including an electrically conductive material, where the groove has a height C and separates the first zone having a height E1 and the second zone having a height E2; and, where when E1 is substantially equal to E2, the winding of the coil is substantially homogeneous and the moving coil has a height $H_B$ that is substantially equal to E1+C, E2+C or E1/2+C+E2/2.

2. A motor according to claim 1, where E1 defines a first gap space of a rear magnetic field B1 and E2 defines a second gap space of a front magnetic field B2.

3. A motor according to claim 2, where the coil includes a first end having NB1 turns and a second end having NB2 turns, and at rest, the first end of the coil intercepts the rear magnetic field B1 and the second end of the coil intercepts the front magnetic field B2.

4. A motor according to claim 3, where the product B1·NB1 is substantially equal to the product B2·NB2 along the height of the coil.

5. A motor according to claim 1, where the gap includes at least one edge and the groove is formed on the edge of the gap.

6. A motor according to claim 1, where the motor further comprises at least one counter-magnet disposed adjacent the first pole piece, the counter-magnet having two poles oppositely magnetized to the poles of the magnet.

7. A motor according to claim 6, where the motor further comprises a pellet made of a ferromagnetic material and disposed adjacent the counter magnet, and where the second pole piece protrudes forwardly to an extent that a protrusion does not exceed the pellet.

8. A motor according to claim 1, where the magnet is a crown magnet and the second pole piece is a substantially flat ring having an inner edge toward a center, and;

where the first pole piece includes:

a base plate on which the magnet rests; and a central core extending perpendicularly to the base plate, and where the front zone and the second zone are disposed between the inner edge of the ring and the central core.

9. A motor according to claim 1, where the electrically conductive material is selected from one of gold, silver, copper, aluminum, graphite carbon, and a combination thereof.

10. A motor according to claim 1, where the electrically conductive material is made of copper.

11. A loudspeaker according to claim 1, where the coil includes a first end having NB1 turns and a second end having NB2 turns, and at rest, the first end intercepts the rear magnetic field B1 and the second end intercepts the front magnetic field B2;

where the magnet is a crown magnet, and the front pole piece is a substantially flat ring having an inner edge toward a center, and;

where the rear pole piece includes a rear plate on which the magnet rests and a central core extending from rear to front, and the inner edge of the ring of the front pole piece and the central core of the rear pole piece define the gap.

12. A loudspeaker according to claim 11, where the product B1·NB1 is substantially equal to the product B2·NB2 along the height $H_B$ of the coil.

13. A moving-coil electrodynamic motor for a loudspeaker comprising:

a magnet having two magnetic poles;

a first pole piece and a second pole piece defining a gap and enclosing a magnetic field in the gap where the magnet is disposed between the first pole piece and the second pole piece and where the gap includes a first zone and a second zone;

a moving coil including a winding of a specific number of turns of an electric conductor and disposed in the gap, where the turns are perpendicular to the magnetic field so that the coil moves in response to a current along a front-rear axis; and, a groove disposed substantially parallel to the turns and including an electrically conductive material, where the groove has a height C and separates the first zone having a height E1 and the second zone having a height E2;

where when E1 is substantially equal to E2, the winding of the coil is substantially homogeneous and the moving coil has a height $H_B$ that is substantially equal to E1+C, E2+C or E1/2+C+E2/2;

where the magnet is a core magnet and the second pole piece includes a substantially flat pellet;

where the first pole piece includes:

a yoke having a U shape and at least one upright edge disposed adjacent the gap; and a base on which the magnet rests; and where the first zone and the second zone are disposed between an edge of the pellet and the upright edge.

14. A loudspeaker having a moving-coil electrodynamic motor comprising:

a magnet having two magnetic poles;

a front pole piece and a rear pole piece defining a gap and enclosing a magnetic field in the gap where the magnet is disposed between the front pole piece and the rear pole piece and where the gap includes a first zone and a second zone;

a moving coil including a winding of a specific number of turns of an electric conductor and disposed in the gap, where the turns are perpendicular to the magnetic field so that the coil moves in response to a current along a front-rear axis;

a diaphragm coupled to the moving coil and responding to the movement of the coil; and, a groove disposed substantially parallel to the turns and including a ring where the ring is continuous and closed and made from an electrically conductive material, and, where the groove has a height C and separates the first zone having a height E1 and the second zone having a height E2; and where the coil is configured to have a height $H_B$ either less than or equal to the height E1+C+E2 of the gap.

15. A loudspeaker according to claim 14, where the ring internally surrounds the groove.

16. A loudspeaker according to claim 15, where the groove includes a base wall and a side wall and connections between, the base wall and the side wall is round.

17. A loudspeaker according to claim 14, when the front pole piece includes a first element and a second element and the ring is inserted in the second element at the level of the groove.

18. A loudspeaker according to claim 17, where the first element is placed on the ring inserted in the second element.

19. A loudspeaker having a moving-coil electrodynamic motor, comprising:

a front pole piece having a first edge and a first pole;

a rear pole piece having a second edge and a second pole where the front pole piece and the rear pole piece define a gap having a first field zone and a second field zone and enclose a magnetic field in the gap; and, a moving coil formed by a winding of a specific number of turns of an electric conductor and disposed in the gap;

a magnet creating the magnetic field that is perpendicular to the turns so that the coil moves in response to a current along a front-rear axis; and, a groove configured to separate the first field zone having a height E1 from the second field zone having a height E2, the groove having a height C and forming on the front pole piece where the groove includes a zone receding from the surface of the front pole piece;

where a height $H_B$ of the coil is equal to E+C when E=E1=E2, and a maximum excursion of the coil ranges from −(E/2+C) to +(E/2+C) relative to the rest position of the coil.

20. A loudspeaker according to claim 19, where the motor further comprises at least one counter-magnet disposed adjacent the front pole piece, the counter-magnet having two poles oppositely magnetized to the poles of the magnet;

where the magnet is a crown magnet, and the front pole piece is a substantially flat ring having an inner edge toward a center, and;

where the rear pole piece includes a rear plate on which the magnet rests and a central core extending from rear to front, and the inner edge of the ring of the front pole piece and the central core of the rear pole piece define the gap.

21. A loudspeaker having a moving-coil electrodynamic motor, comprising:

a front pole piece having a first edge and a first pole;

a rear pole piece having a second edge and a second pole where the front pole piece and the rear pole piece define a gap having a first field zone and a second field zone and enclose a magnetic field in the gap; and, a moving coil formed by a winding of a specific number of turns of an electric conductor and disposed in the gap;

a magnet creating the magnetic field that is perpendicular to the turns so that the coil moves in response to a current along a front-rear axis; and, a groove configured to separate the first field zone having a height E1 from the second field zone having a height E2, the groove having a height C and forming on the front pole piece where the groove includes a zone receding from the surface of the front pole piece;

where a height $H_B$ of the coil is equal to E+C when E=E1=E2, and a maximum excursion of the coil ranges from −(E/2+C) to +(E/2+C) relative to the rest position of the coil;

where the moving-coil electrodynamic motor further comprises at least one counter-magnet disposed adjacent the front pole piece, the counter-magnet having two poles oppositely magnetized to the poles of the magnet; and where the magnet is a core magnet, and the front pole piece is a substantially flat pellet, and;

where the rear pole piece includes a yoke having a U shape and at least one upright edge and a base on which the magnet rests, and an edge of the pellet and the upright edge define the gap.

22. A loudspeaker having a moving-coil electrodynamic motor, comprising:

a front pole piece having a first edge and a first pole;

a rear pole piece having a second edge and a second pole where the front pole piece and the rear pole piece define a gap having a first field zone and a second field zone and enclose a magnetic field in the gap; and, a moving coil formed by a winding of a specific number of turns of an electric conductor and disposed in the gap;

a magnet creating the magnetic field that is perpendicular to the turns so that the coil moves in response to a current along a front-rear axis; and, a groove configured to separate the first field zone having a height E1 from the second field zone having a height E2, the groove having a height C and forming on the front pole piece where the groove includes a zone receding from the surface of the front pole piece.

where a height $H_B$ of the coil is equal to E+C when E=E1=E2, and a maximum excursion of the coil ranges from −(E/2+C) to +(E/2+C) relative to the rest position of the coil, where the coil includes a first end having NB1 turns and a second end having NB2 turns, and at rest, the first end intercepts the rear magnetic field B1 and the second end intercepts the front magnetic field B2;

where the magnet is a core magnet and the front pole piece is a substantially flat pellet, and;

where the rear pole piece includes a yoke having a U shape and at least one upright edge and a base on which the magnet rests, and an edge of the pellet and the upright edge of the yoke define the gap.

23. A loudspeaker according to claim 22, where the product B1·NB1 is substantially equal to the product B2·NB2 along the height $H_B$ of the coil.

24. A moving-coil electrodynamic motor for a loudspeaker comprising:

a magnet having two magnetic poles;

a first pole piece and a second pole piece defining a gap and enclosing a magnetic field in the gap where the magnet is disposed between the first pole piece and the second pole piece and where the gap includes a first zone and a second zone;

a moving coil including a winding of a specific number of turns of an electric conductor and disposed in the gap, where the turns are perpendicular to the magnetic field so that the coil moves in response to a current along a front-rear axis; and, a groove disposed substantially parallel to the turns and including an electrically conductive material, where the groove has a height C and separates the first zone having a height E1 and the second zone having a height E2; and, where when at least one of the first pole piece or the second pole piece is inclined to form a different width of the gap in the first zone and the second zone, the winding of the coil is not homogeneous and the product $H_B$·E1 or $H_B$·E2 is constant.

* * * * *